US006527820B2

(12) United States Patent
Stöpler

(10) Patent No.: US 6,527,820 B2
(45) Date of Patent: Mar. 4, 2003

(54) SOOT FILTER FOR DIESEL EXHAUST

(75) Inventor: Walter Stöpler, Herzogenaurach (DE)

(73) Assignee: Faurecia Abgastechnik GmbH, Fürth (DE)

( * ) Notice: Subject to any disclaimer, the term of this patent is extended or adjusted under 35 U.S.C. 154(b) by 0 days.

(21) Appl. No.: 09/883,903

(22) Filed: Jun. 18, 2001

(65) Prior Publication Data

US 2001/0054277 A1 Dec. 27, 2001

(30) Foreign Application Priority Data

Jun. 16, 2000 (DE) ..... 100 28 987

(51) Int. Cl.[7] ..... B01D 46/24; F01N 3/027

(52) U.S. Cl. ..... 55/282.3; 55/282.2; 55/385.3; 55/523; 55/DIG. 30; 95/283

(58) Field of Search ..... 55/282.3, 282.2, 55/282.4, 282.5, 523, DIG. 30, 385.3; 95/283; 60/303, 311

(56) References Cited

U.S. PATENT DOCUMENTS

| | | | | | |
|---|---|---|---|---|---|
| 3,911,326 | A | * | 10/1975 | Ohlsson | 123/145 A |
| 4,240,392 | A | * | 12/1980 | Matayoshi et al. | 123/145 A |
| 4,397,273 | A | * | 8/1983 | Folkerts | 123/145 A |
| 4,424,671 | A | * | 1/1984 | Tokura | 60/311 |
| 4,450,682 | A | * | 5/1984 | Sato et al. | 55/523 |
| 4,503,672 | A | * | 3/1985 | Stark et al. | 55/DIG. 30 |
| 4,576,617 | A | * | 3/1986 | Renevot | 55/282 |

* cited by examiner

*Primary Examiner*—Duane Smith
*Assistant Examiner*—Jason M. Greene
(74) *Attorney, Agent, or Firm*—Laurence A. Greenberg; Werner H. Stemer; Ralph E. Locher

(57) ABSTRACT

A soot filter for the exhaust gas of a diesel engine comprises a filter body and a glow plug for thermally regenerating the filter body. At least one glow rod has a contact part that is spring-mounted at the glow rod in an axially displaceable fashion. Its face side which is averted from the glow plug shaft, therefore, protrudes beyond the free end of the glow rod and is pressed onto the face of the filter body.

18 Claims, 10 Drawing Sheets

SOOT FILTER FOR DIESEL EXHAUST

BACKGROUND OF THE INVENTION

FIELD OF THE INVENTION

The invention relates to a soot filter for the exhaust from a diesel engine.

Such soot filters comprise a substantially cylindrical filter, particularly a filter made of ceramic material, which is penetrated by channels in the longitudinal direction. The walls of the channels are porous, so that exhaust gas flowing into a channel enters into neighboring channels via the pores. The ends facing against the flow direction are sealed in these neighboring channels, whereas the ends that face into the flow direction are sealed in the former channels. By this, the exhaust gas is forced to flow from a central channel into neighboring channels by way of the perforations. Soot particles therefore settle in the channels.

To regenerate the filter, at least one glow plug is provided, which has an approximately bolt-shaped glow rod, the free end of which is disposed near the filter or touches it. In conventional plugs, the free end of the glow rod is disposed relatively near the front face of the filter body, so that a local heating of the filter body can occur, thereby heating the soot particles to their ignition temperature. In order to make possible a more reliable ignition and thus a self-cleaning of the filter body, a very small distance and a relatively large contact surface between the glow plug and the filter body are required. In conventional soot filters, this is not sufficiently ensured. Due to the in part very high component and production tolerances and also due to the different coefficients of thermal expansion of the glow plug and the filter body, the precise and reliable arrangement of the glow plug at the face side of the filter body is problematic.

SUMMARY OF THE INVENTION

The object of the present invention is to provide a soot filter for diesel exhaust which overcomes the above-noted deficiencies and disadvantages of the prior art devices and methods of this general kind, and which is further improved in this respect.

With the above and other objects in view there is provided, in accordance with the invention, a soot filter for the exhaust gas of a diesel engine, comprising:

a filter body having a face;

at least one glow plug for thermally regenerating the filter body, the at least one glow plug having a glow plug shaft, a glow rod adjacent the glow plug shaft, and a contact part spring-mounted and axially displaceable on the glow rod, the contact part having a face side, averted from the glow plug shaft, pressed onto the face of the filter body.

In accordance with an added feature of the invention, the glow rod has a free end and the contact part projects beyond the free end of the glow rod.

In accordance with an additional feature of the invention, the face of the filter body is formed with a recess and the glow rod has a free end projecting into the recess.

In accordance with another feature of the invention, the contact part is braced at the glow plug shaft in a springing fashion. Preferably, there is provided a spiral spring spring-mounting the contact part.

In accordance with again an added feature of the invention, the spiral spring contacts the glow rod at least at a spring part facing the glow plug shaft.

In another advantageous embodiment, the spiral spring has a face-side winding mounted in a groove surrounding the glow plug shaft.

In accordance with again an additional feature of the invention, the contact part is a sleeve.

In accordance with again another feature of the invention, the spiral spring has an opposite face-side winding mounted in a groove surrounding the contact part. The contact part may be open at its free end or it may be sealed at its free end. Also, the free end may have a round face.

In accordance with yet an added feature of the invention, the contact part comprises an inner sleeve glidingly and displaceably mounted at the glow rod, and an outer sleeve surrounding the inner sleeve at a distance, and the sleeves are connected to each other at a face side thereof averted from the glow plug by a bearing ring formed with a plurality of through-openings. In a preferred embodiment, the contact part is a one-piece molded part.

In accordance with yet another feature of the invention, the contact part is a one-piece contact part wound from a spring wire, and the contact part is wound, at least at the free end, so as to make gliding contact with the glow rod.

In accordance with yet a further feature of the invention, the spring wire is wound in the region of the free end with windings touching each other.

In accordance with a concomitant feature of the invention, the spring wire has a substantially rectangular cross-section, or a square cross-section.

Other features which are considered as characteristic for the invention are set forth in the appended claims.

Although the invention is illustrated and described herein as embodied in a soot filter for Diesel exhaust, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
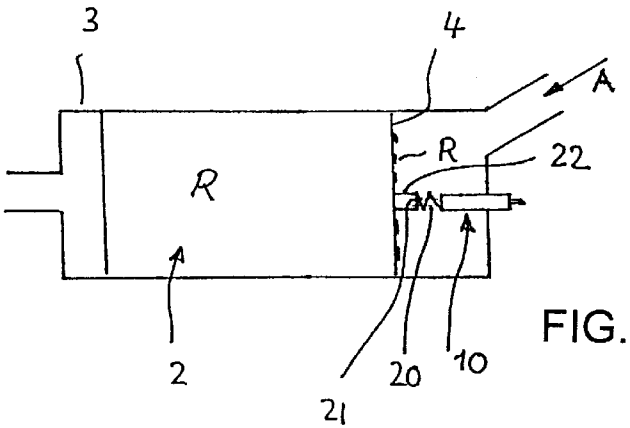
FIG. 1 is a schematic side view of a soot filter according to the invention.

Referring now to the figures of the drawing in detail and first, particularly, to FIG. 1 thereof, there is seen a soot filter comprising a filter body 2, which is disposed in a housing 3 and through which an exhaust gas A from a diesel engine passes. Soot particles R contained in the exhaust gas settle both in the interior of the filter body 2 and at its face side 4. A number of glow plugs 10 are screwed in at the housing 3. only one of the plugs 10 is represented in the figure for reasons of simplicity. The glow plugs 10 project into the interior of the housing 3 such that their glow rod 20 is disposed with its free end 21 near the face 4 of the filter body 2.

A contact part 22 is disposed at the glow rod 20 in a springing and axially displaceable fashion such that in the neutral position, i.e. given a relaxed spring, its face side 24 that is averted from the glow plug shaft projects beyond the free end 21 of the glow rod 20. The contact part 22 consists of a preferably metallic material that is a good thermal conductor, so that good thermal contact between the glow rod 20 and the face side 4 of the filter body 2 is guaranteed, even given unavoidable production tolerances and given spacing variations between the free end 21 and the face end 4 as a consequence of thermal expansion.

Figure 2:
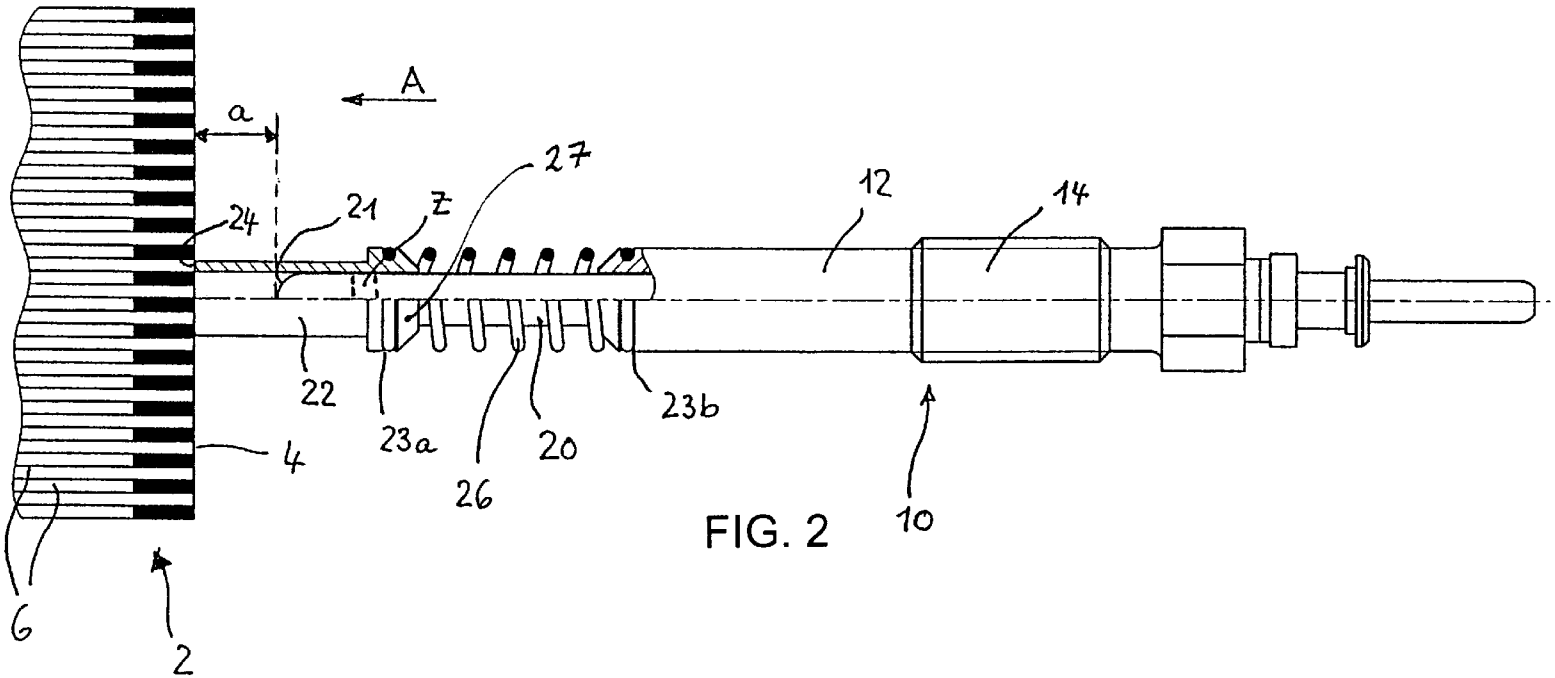
FIGS. 2 to 6 illustrate embodiments of a soot filter according to the invention wherein a sleeve-shaped contact part is provided, which braces at the shaft of the glow plug with the aid of a spring.

According to FIG. 2, the filter body 2 comprises a plurality of mutually adjacent channels 6 which are sealed at alternate ends either opposite the flow direction or in the flow direction. The glow plug 10, whose shaft 12 comprises a thread 14 that holds it in the housing 3 (FIG. 1), is disposed opposite the face 4.

The glow rod 20 projects beyond the glow plug shaft 12. The glow rod 20 is electrically heatable such that a temperature of more than 1000° C. is achieved in an approximately annular ignition zone Z situated at a distance of a few millimeters, for instance 4 mm, from the free end 21 of said glow rod. This high temperature is necessary in order to ignite the soot and to initiate an afterburning of the soot. In order to guarantee that its afterburning propagates into the interior of the filter head 2 as an exothermic reaction and effectuates an oxidation of the soot located in the filter body 2, it is necessary to ignite the soot at the face 4 of the filter body 2.

It has proven impossible to reliably induce such ignition given a distance a of more than a few tenths of a millimeter (which is enlarged in the figure for artistic reasons) between the free end 21 of the glow rod 20 and the face 4 of the filter body 2. In order to guide the temperature required to ignite the soot particles onto the face 4 of the filter body 2, a sleeve-shaped contact part 22 is pushed onto the glow rod 20, such that its interior surface rests on the glow zone Z of the glow rod 20 in a sliding fashion and is thus in good thermal contact therewith.

At the end facing the glow plug shaft 12, the contact part 22 comprises a groove 23*a* which surrounds it in the shape of a ring, wherein the face-side winding of a spiral spring 26 is borne. Likewise, the spiral spring 26 is borne with its opposite face-side winding in a groove 23*b* that wraps around the plug shaft 12 in the shape of a ring, so that the face side 24 (an annular contact surface in this exemplary embodiment) of the contact part 22 is pressed to the face 4 in a springing fashion.

It is thus possible to compensate unavoidable tolerances in the spacing between the free end 21 of the glow rod 20 and the face 4 of the filter body 2 with the aid of the spiral spring 26. A sufficient heat transfer is thus guaranteed by the contact part 22 by heat conduction via the annular contact surface 24, on one hand, and by heat radiation in the interior of the contact part 22, which is open at its face side, on the other hand, even given an expansion of the spacing a between the free end 21 and the face 4 beyond the critical dimension of a few tenths of a millimeter.

In the exemplary embodiment it can be recognized that the grooves 23*a,b* that are provided for receiving the terminal windings of the spiral spring 26 are radially spaced from the surface of the glow rod 20, so that the helical spring (spiral spring) 26 does not touch the glow rod 20. To accomplish this, the end of the contact part 22 facing the glow plug 10 is provided with a flange-type wall thickening 27 into which the groove 23*a* can be installed with a sufficient distance between the bottom of the groove and the surface of the glow rod 50. This prevents excessive heating of the spiral spring 26, which would adversely influence its service life.

Figure 3:
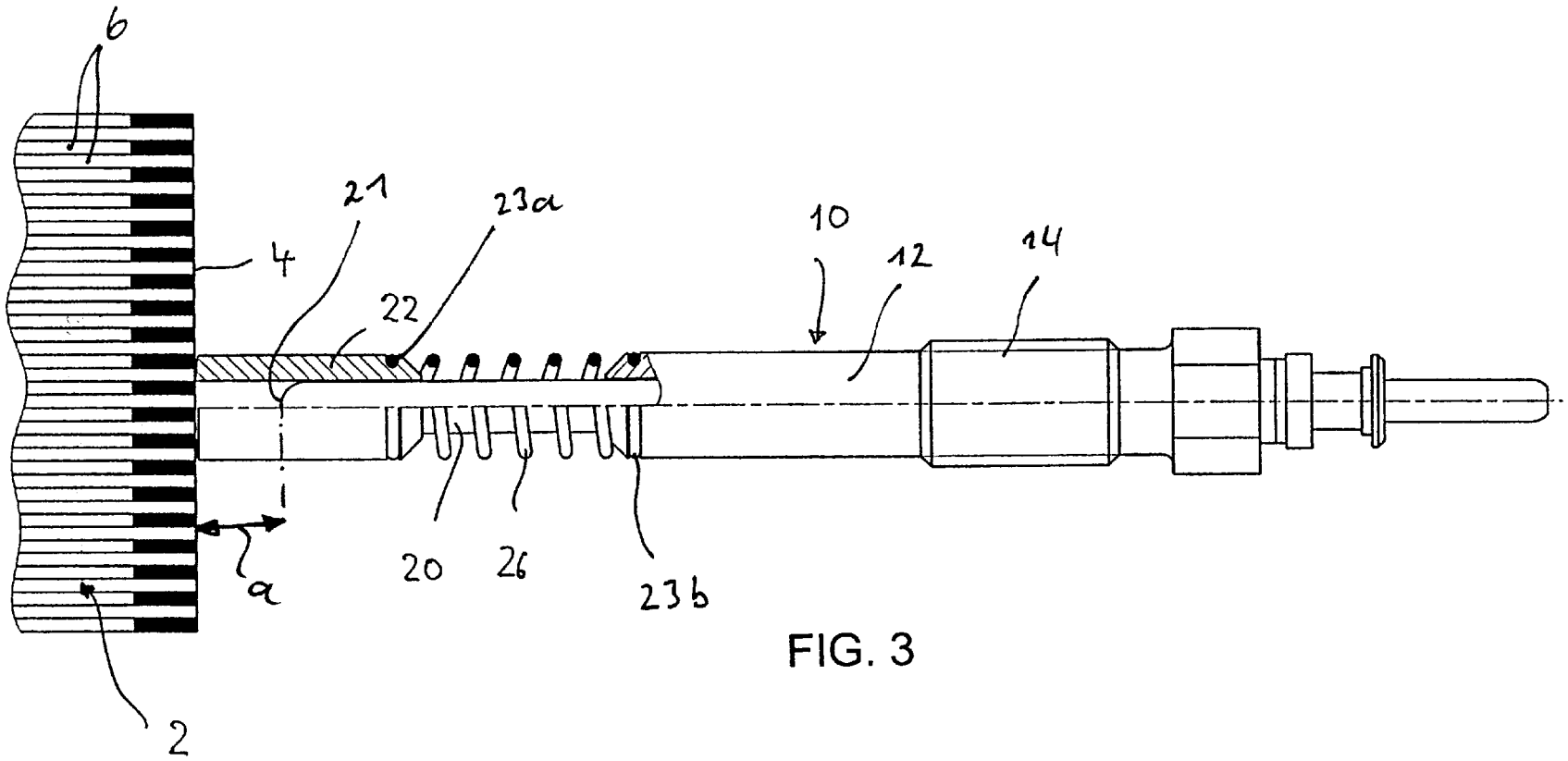

Alternatively, the contact part 22 represented in FIG. 3 can also be realized as a sleeve comprising an approximately by constant wall thickness along its entire length.

Figure 4:
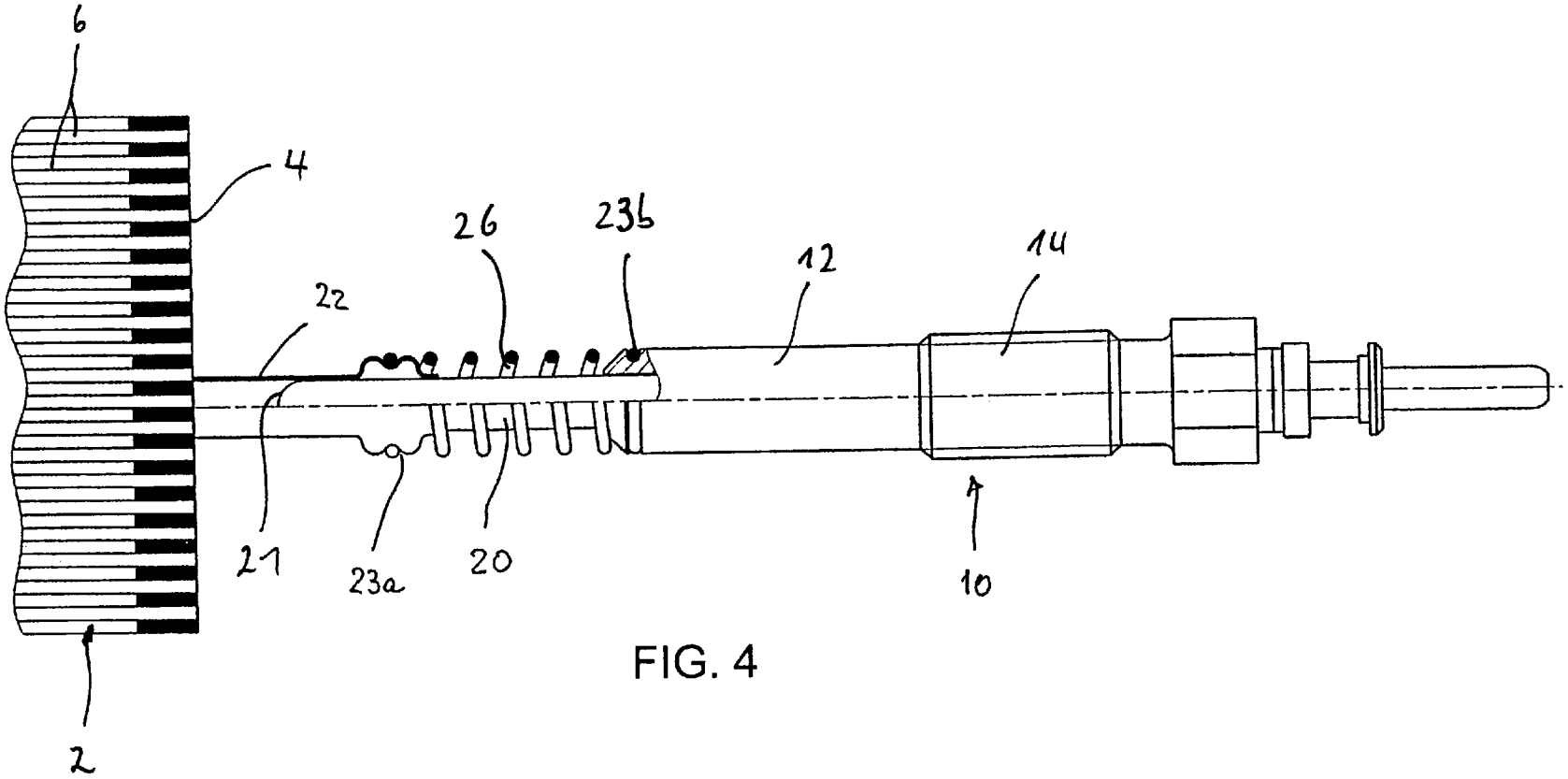

A rotary part is provided as contact part 22 in the exemplary embodiments in FIGS. 2 and 3. Alternatively, as represented in FIG. 4, a molded part formed from thin-walled sheet may also be provided as contact part 22, with the groove 23a being impressed therein at a distance from the surface of the glow rod 20 by a corresponding forming process.

Figure 5:
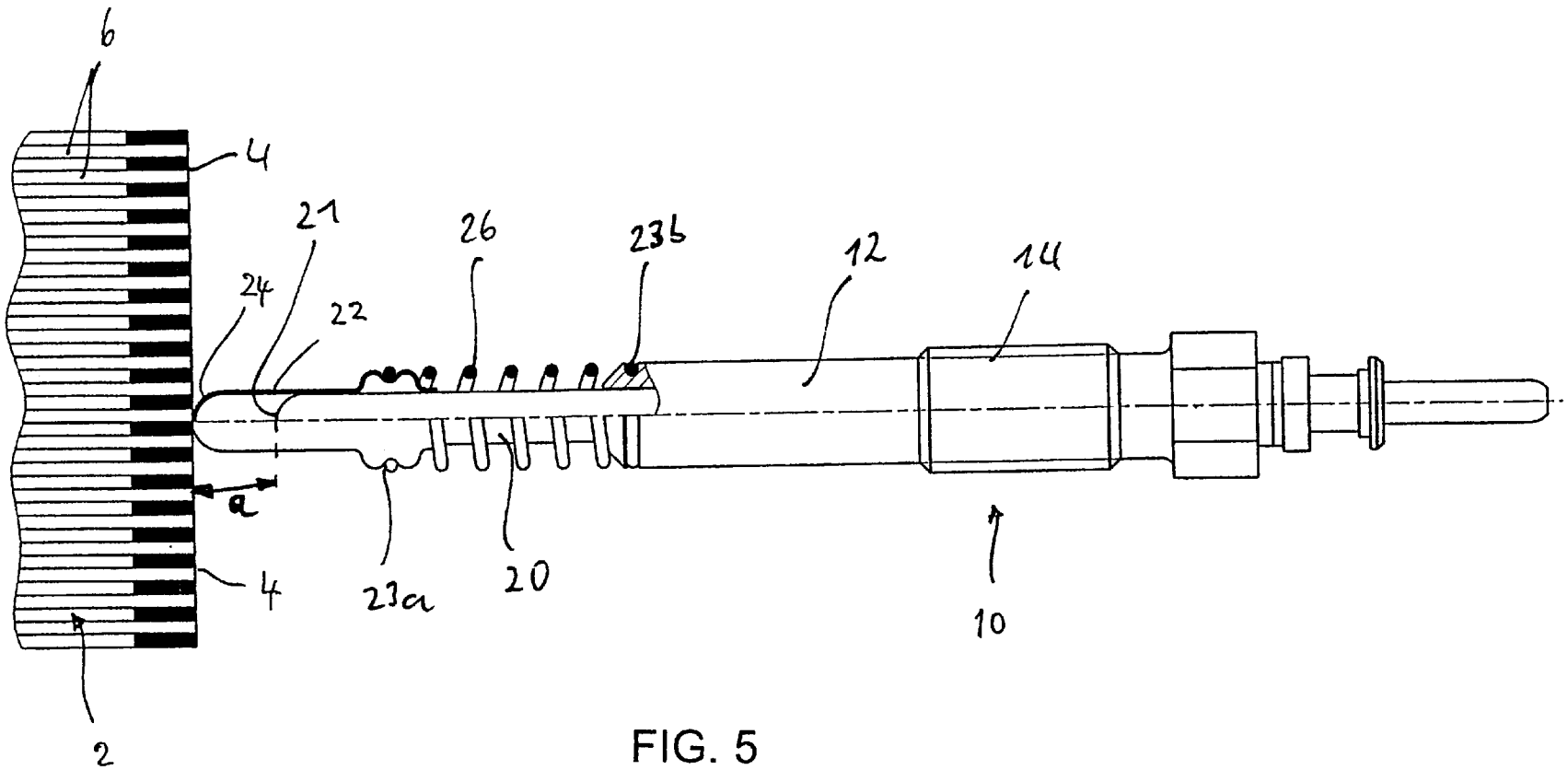

According to FIG. 5, the face side 24 of the contact part 22, which is averted from the glow plug 10, is sealed and provided with a round spherical face. The advantage of this is that good contact—here, approximately point-to-point contact—with the face 4 of the filter body 2 is always guaranteed, even if the glow plug is installed at a slant.

Figure 6:
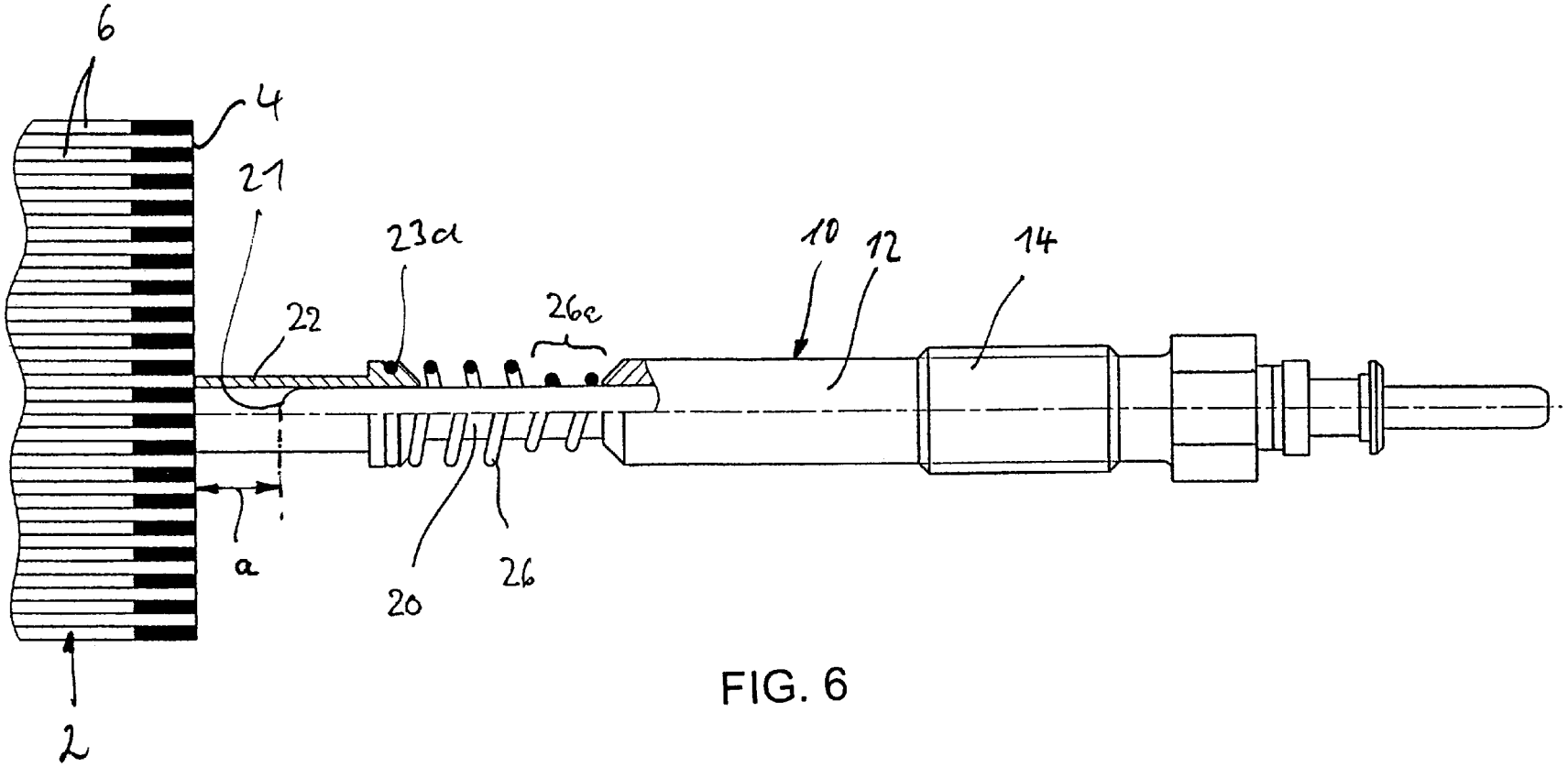

According to FIG. 6, the length of the spiral spring 26 which is provided for the spring bearing of the contact part 22 is wound with different radii, such that the windings of this spring on a part 26*a* of the spring length that faces the glow plug shaft 12 make contact with the glow plug in a gliding fashion. This way, the groove 23*b* (FIG. 1) which is disposed in the glow plug 12 in the preceding exemplary embodiment is omitted. This embodiment is based on the consideration that the temperature in the glow rod 20 is relatively low in the region of the glow plug, so that thermal contact with the windings does not adversely affect the life of the spiral spring 26.

Figure 7:
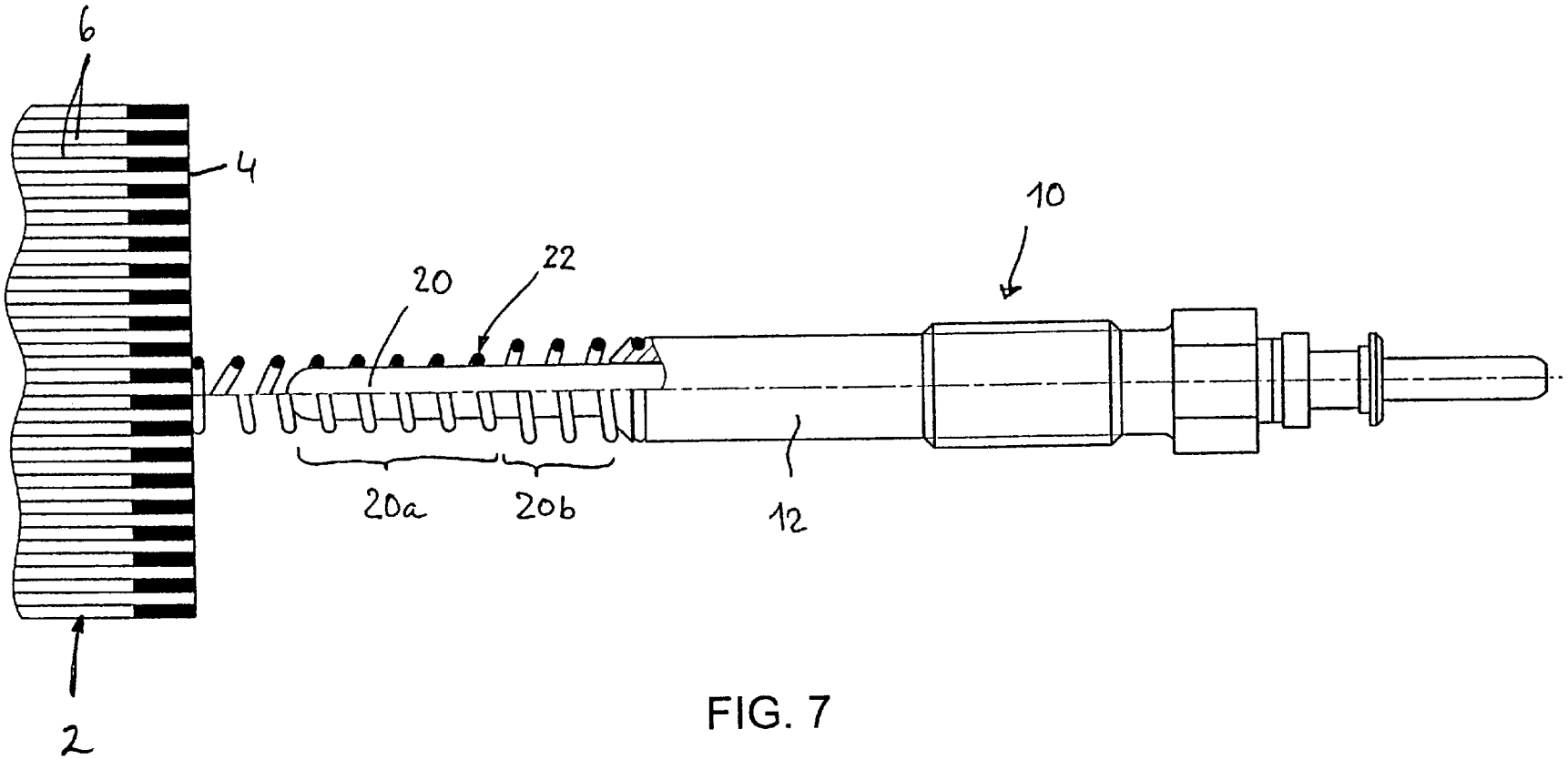
FIGS. 7 to 9 illustrate exemplary embodiments wherein the contact part is wound from a spring wire in one piece.

According to FIG. 7, the contact part 22 itself is constructed as a spiral spring whose windings make contact with the glow rod 20 at least in the region 20a of the glow rod which is averted from the glow plug 12. In the exemplary embodiment, in the region 20*b* of the glow rod 20 facing the glow plug shaft 12 this spiral spring is wound with a larger radius and thus at a remove from the glow rod 20, so that at least for this region of the spiral spring, a thermal load which would adversely influence the spring response over a longer lifetime is avoided.

Figure 8:
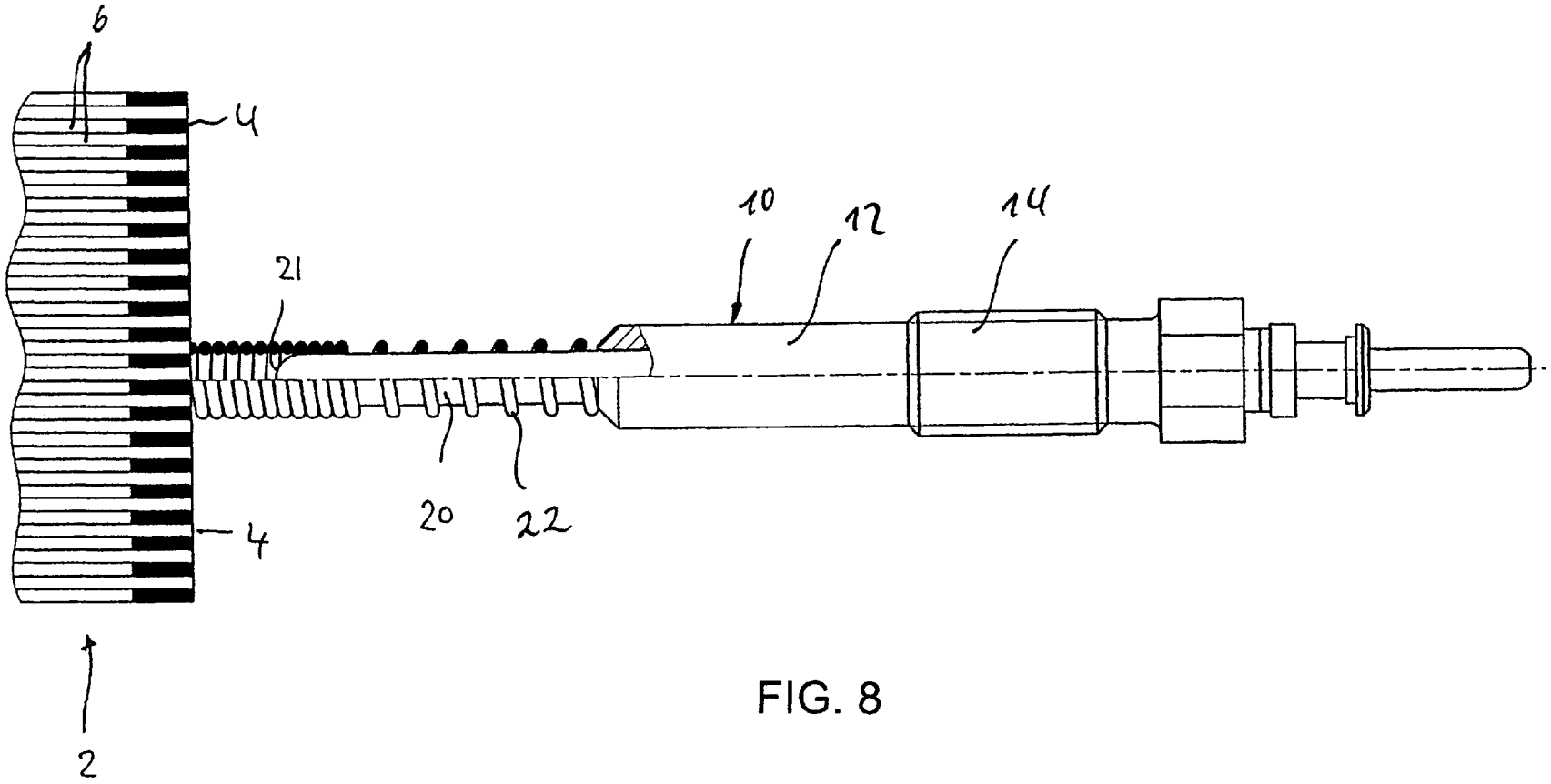

According to FIG. 8, the windings of the contact part 22, which is formed from a spring wire, are closely adjacent in the region of the free end 21, so that they touch one another and form a closed sleeve. In this exemplary embodiment, the diameter of the winding is constant, so that the spiral spring is also slide-mounted on the glow rod 20 in its actual spring region.

Figure 9:
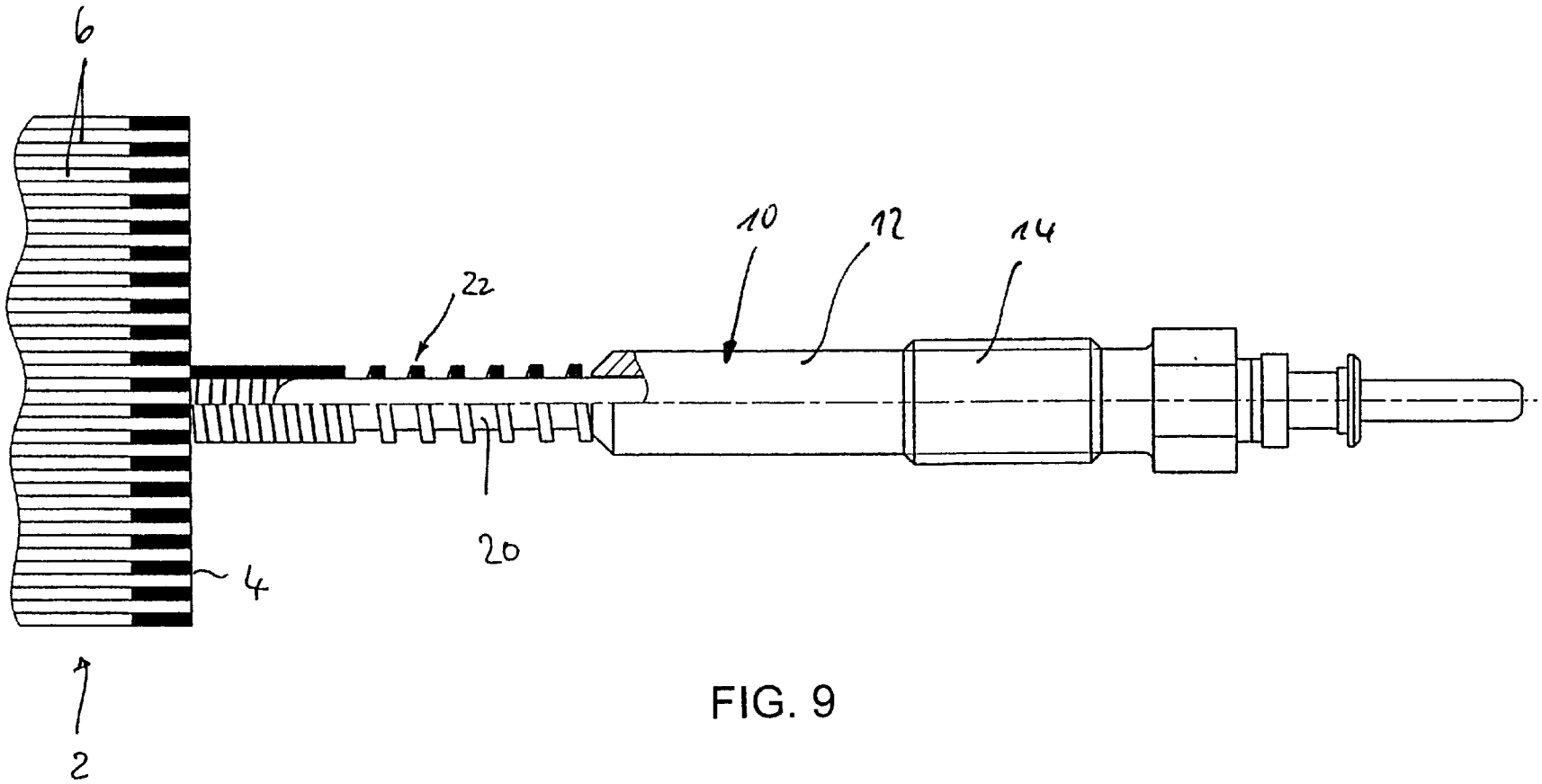

According to FIG. 9, a spring wire with a rectangular cross-section is provided for the contact part 22, so that a sleeve wherein the individual windings contact one another over a large surface area emerges in the region of the free end of the glow rod 20.

Figure 10:
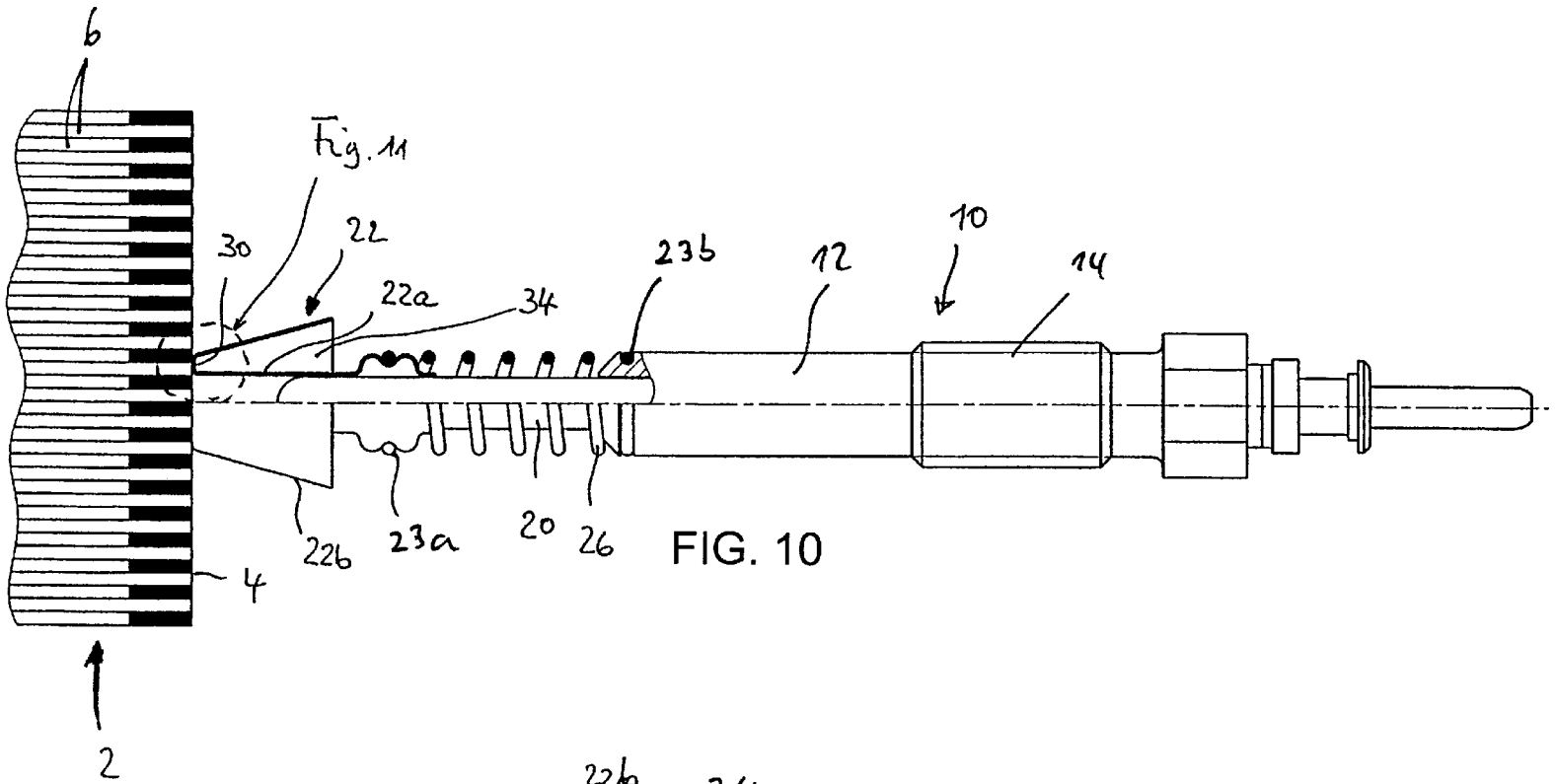
FIG. 10 illustrates an exemplary embodiment wherein the contact part is simultaneously configured as a collecting container for soot particles.
Figure 11:
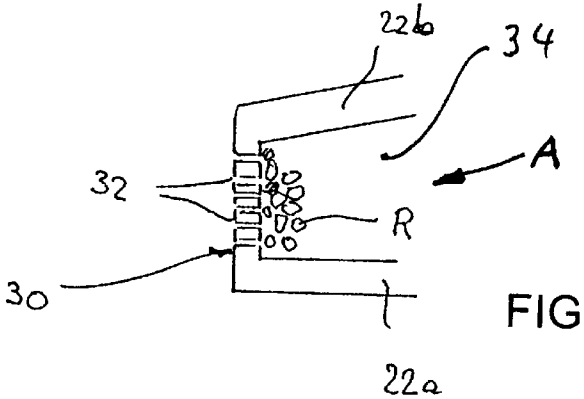
FIG. 11 is an enlarged sectional view of the contact part of FIG. 10 in the region of the face side.

According to FIG. 10, the contact part 22 comprises an inner sleeve 22*a*, which is mounted at the glow rod 20 in a gliding and displaceable fashion and which is surrounded by an outer sleeve 22*b* at a distance. The face sides, which are averted from the glow plug, of the inner sleeve 22*a* and the outer sleeve 22b are connected to each other by a bearing ring 30, which comprises a plurality of through openings 32 as represented in the enlarged view in FIG. 11. The exhaust gas A flows through the collecting space 34 between the inner sleeve 22*a* and the outer sleeve 22*b* (a conical space in the present exemplary embodiment), and soot particles R settle at the through openings 32. By settling in the collecting space 32, the particles move closer to the actual heat zone of the glow rod 20, thereby facilitating the inception of afterburning. In addition, owing to the in the burning of these soot particles located in the collecting space 34, additional heat energy is released, which enables the required ignition temperature at the face 4 of the filter head 2 to be attained.

Figure 12:
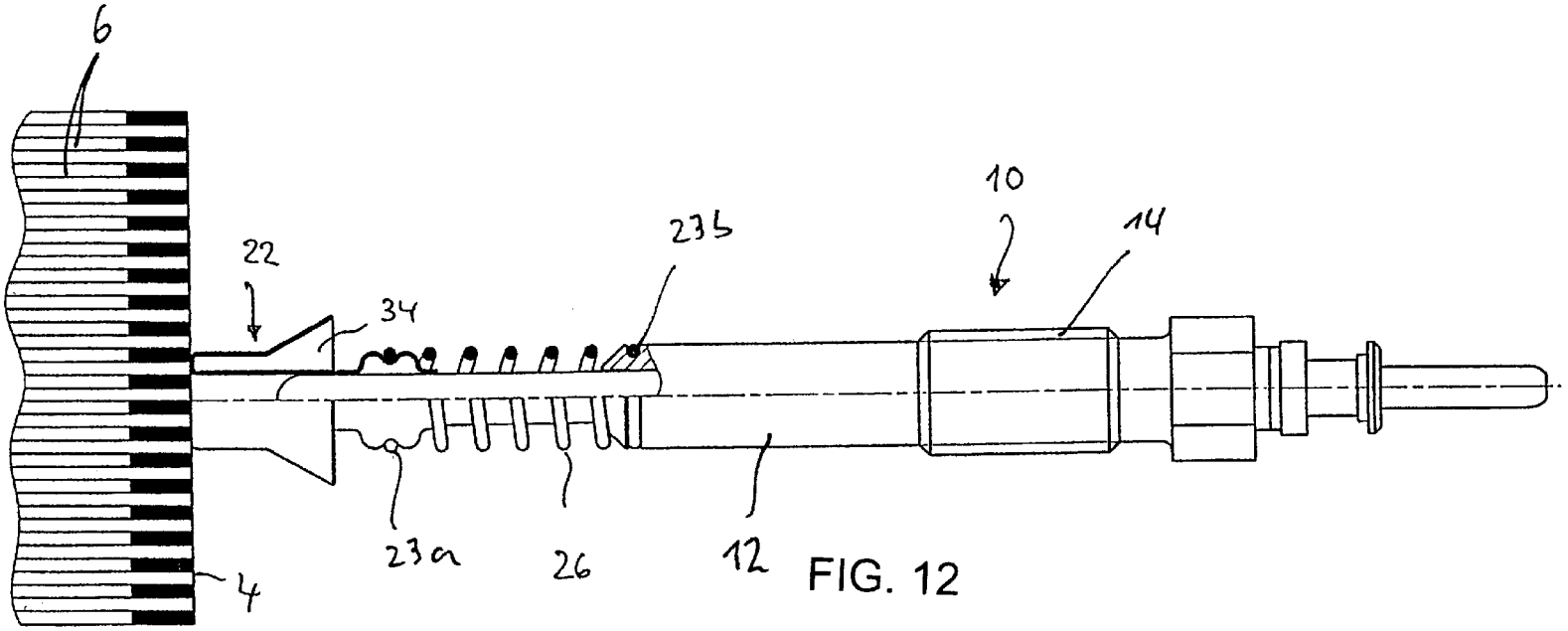
FIG. 12 illustrates an additional exemplary embodiment with a contact part that is configured as a collecting container.

According to FIG. 12, an approximately funnel-shaped collecting space 34 is provided instead of a conical collecting space.

Figure 13:
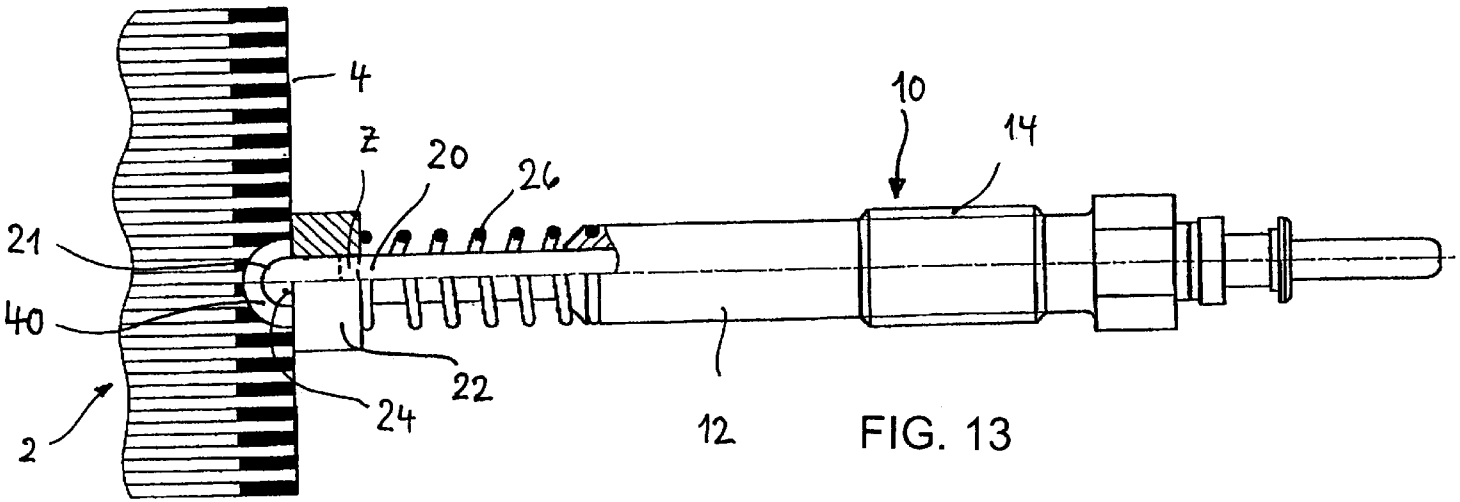
FIG. 13 illustrates another advantageous development of the invention, wherein the free end of the glow rod projects beyond the contact part into a recess of the filter body.

In the exemplary embodiment according to FIG. 13, the face 4 of the filter body 2 is provided with a depression or recess 40 into which the free end 21 of the glow rod 20 protrudes. As in the exemplary embodiment according to FIG. 1, the contact part 22 has the shape of a sleeve which surrounds the glow rod 20. However, unlike in the exemplary embodiment according to FIG. 1, in the exemplary embodiment according to FIG. 13 the free end 21 of the glow rod 20 protrudes beyond the face side 24 of the contact part 22. The outer diameter of the sleeve-shaped contact part 22 is larger than the diameter of the recess 40, so that the contact part 22 is pressed to the face side 4 of the filter body 2 by the spiral spring 26. Since the free end 21 protrudes into the filter body 2, the glow zone Z is located closer to its face side 4. Furthermore, since the contact part 22 is shorter than in the embodiment according to FIG. 1, the thermal contact between the glow rod 20 and the filter body 2 is improved.

Instead of the sleeve-shaped contact part 22 represented in FIG. 13, a development of the contact part 22 in accordance with the exemplary embodiments represented in FIG. 10 or FIG. 12 is advantageous in this embodiment as well.

I claim:

1. A soot filter for the exhaust gas of a diesel engine, comprising:

a filter body having a face;

at least one glow plug for thermally regenerating said filter body, said at least one glow plug having a glow plug shaft, a glow rod adjacent said glow plug shaft, and a contact part spring-mounted and axially displaceable on said glow rod, said contact part having a face side, averted from said glow plug shaft, pressed onto said face of said filter body.

2. The soot filter according to claim 1, wherein said glow rod has a free end and said contact part projects beyond said free end of said glow rod.

3. The soot filter according to claim 1, wherein said face of said filter body is formed with a recess and said glow rod has a free end projecting into said recess.

4. The soot filter according to claim 1, wherein said contact part is braced at said glow plug shaft in a springing fashion.

5. The soot filter according to claim 4, which comprises a spiral spring spring-mounting said contact part.

6. The soot filter according to claim 5, wherein said spiral spring contacts said glow rod at least at a spring part facing said glow plug shaft.

7. The soot filter according to claim 5, wherein said spiral spring has a face-side winding mounted in a groove surrounding said glow plug shaft.

8. The soot filter according to claim 1, wherein said contact part is a sleeve.

9. The soot filter according to claim 5, wherein said spiral spring has an opposite face-side winding mounted in a groove surrounding said contact part.

10. The soot filter according to claim 8, wherein said contact part is open at a free end thereof.

11. The soot filter according to claim 8, wherein said contact part is sealed at a free end thereof.

12. The soot filter according to claim 11, wherein said contact part is formed with a round face at said free end thereof.

13. The soot filter according to claim 1, wherein said contact part comprises an inner sleeve glidingly and displaceably mounted at said glow rod, and an outer sleeve surrounding said inner sleeve at a distance, and said sleeves are connected to each other at a face side thereof averted from said glow plug by a bearing ring formed with a plurality of through-openings.

14. The soot filter according to claim 13, wherein said contact part is a one-piece molded part.

15. The soot filter according to claim 1, wherein said contact part is a one-piece contact part wound from a spring wire, and said contact part is wound, at least at said free end, so as to make gliding contact with said glow rod.

16. The soot filter according to claim 15, wherein said spring wire is wound in the region of said free end with windings touching each other.

17. The soot filter according to claim 16, wherein said spring wire has a substantially rectangular cross-section.

18. The soot filter according to claim 16, wherein said spring wire has a substantially square cross-section.

* * * * *